US011534807B2

(12) United States Patent
Wang et al.

(10) Patent No.: US 11,534,807 B2
(45) Date of Patent: Dec. 27, 2022

(54) TENSION SYSTEM OPTIMIZATION METHOD FOR SUPPRESSING VIBRATION OF COLD TANDEM ROLLING MILL

(71) Applicant: BAOSHAN IRON & STEEL CO., LTD., Shanghai (CN)

(72) Inventors: Kangjian Wang, Shanghai (CN); Tao Zheng, Shanghai (CN); Shanqing Li, Shanghai (CN); Xiaoming Chen, Shanghai (CN); Peilei Qu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 20 days.

(21) Appl. No.: 17/258,888

(22) PCT Filed: Jul. 24, 2019

(86) PCT No.: PCT/CN2019/097397

§ 371 (c)(1),
(2) Date: Jan. 8, 2021

(87) PCT Pub. No.: WO2020/020192

PCT Pub. Date: Jan. 30, 2020

(65) Prior Publication Data

US 2022/0134399 A1 May 5, 2022

(30) Foreign Application Priority Data

Jul. 26, 2018 (CN) ..... 201810831304.0

(51) Int. Cl.
*B21B 37/00* (2006.01)
*B21B 37/48* (2006.01)

(52) U.S. Cl.
CPC ..... *B21B 37/007* (2013.01); *B21B 37/48* (2013.01)

(58) Field of Classification Search
CPC ..... B21B 37/007; B21B 37/78; B21B 38/008; B21B 38/06; B21B 2256/02;
(Continued)

(56) References Cited

U.S. PATENT DOCUMENTS 6,276,183 B1 * 8/2001 Benedetti ..... B21B 37/007 72/236
6,510,721 B1 * 1/2003 Yamamoto ..... B21B 13/023 72/28.2

(Continued)

FOREIGN PATENT DOCUMENTS

CN 1979497 A 6/2007
CN 107695108 A 9/2010

(Continued)

OTHER PUBLICATIONS

English translate (CN104942021B), retrieved date Apr. 21, 2022.*

(Continued)

*Primary Examiner* — Jessica Cahill
*Assistant Examiner* — Mohammed S. Alawadi
(74) *Attorney, Agent, or Firm* — Thomas Spath

(57) ABSTRACT

The application discloses a tension system optimization method for suppressing vibration of a cold tandem rolling mill. The method aims to suppress vibration occurring in a high-speed rolling process of a cold tandem rolling mill, and provides a rolling machine vibration determination index coefficient for effectively determining whether vibration occurs in a rolling machine. The method employs a target optimization function F(X) such that a mean square error between an optimal value $\psi_{0i}$ of the rolling machine vibration determination index and a vibration determination index $\psi_i$ of each machine frame acquired in an actual rolling process is at a minimum, and such that a maximum value of the rolling machine vibration determination index coeffi- (Continued)

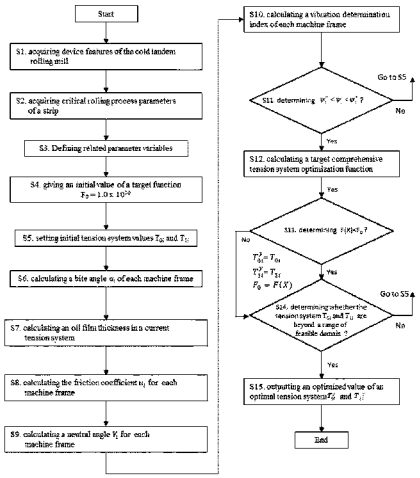

cient of each individual machine frame is also at a minimum, employs a constraint in which an upper threshold $\psi_i^+$ of the vibration determination index is acquired during a rolling process in an over-lubricated state in which a neutral angle $\gamma_i$ coincides with a bite angle $\alpha_i$ and a constraint in which a lower threshold $\psi_i^-$ of the vibration determination index is acquired during a rolling process in an under-lubricated state in which the neutral angle $\gamma_i$ is half the bite angle $\alpha_i$, thereby ultimately optimizing a tension system of a rolling process of a cold tandem rolling mill.

4 Claims, 1 Drawing Sheet

(58) Field of Classification Search
CPC ..... B21B 2256/04; B21B 2001/221; B21B 45/0239; B21B 45/0251; B21B 45/0266; B21B 2261/014; B21B 2265/20
See application file for complete search history.

(56) References Cited

U.S. PATENT DOCUMENTS

| | | | | |
|---|---|---|---|---|
| 9,599,131 | B2 * | 3/2017 | De Luca | B21B 29/00 |
| 2001/0003112 | A1 * | 6/2001 | Kirchner | F16C 13/024 492/20 |
| 2008/0250836 | A1 * | 10/2008 | Gouttebroze | B21B 37/007 188/313 |
| 2015/0013417 | A1 * | 1/2015 | Noe | B21D 1/05 72/160 |
| 2016/0023257 | A1 * | 1/2016 | Brown | B21B 35/00 72/12.3 |
| 2018/0290191 | A1 * | 10/2018 | Krueger | B21B 38/008 |

FOREIGN PATENT DOCUMENTS

| | | | | | |
|---|---|---|---|---|---|
| CN | 101864517 | A | | 10/2010 | |
| CN | 102125936 | A | | 7/2011 | |
| CN | 103302108 | A | | 9/2013 | |
| CN | 103544340 | A | | 1/2014 | |
| CN | 103544340 | A | * | 1/2014 | |
| CN | 103861872 | A | * | 6/2014 | B21B 37/007 |
| CN | 104289528 | A | * | 1/2015 | |
| CN | 104785537 | A | | 7/2015 | |
| CN | 104785539 | A | | 7/2015 | |
| CN | 104889175 | A | | 9/2015 | |
| CN | 105522000 | A | | 4/2016 | |
| CN | 106311765 | A | * | 1/2017 | B21B 38/00 |
| CN | 104942021 | B | * | 3/2017 | |
| CN | 107790505 | A | | 3/2018 | |
| DE | 3609623 | A1 | * | 10/1987 | |
| JP | 2010214453 | A | | 9/2010 | |
| JP | 2016153138 | A | | 8/2016 | |
| KR | 970010776 | B1 | * | 7/1997 | |

OTHER PUBLICATIONS

English translate(CN104289528A), retrieved date Apr. 21, 2022.*
English translate (CN103861872A), retrieved date Apr. 21, 2022.*
English translate (CN103544340A), retrieved date Apr. 21, 2022.*
English translate (CN106311765A), retrieved date Apr. 21, 2022.*
English translate (KR970010776B1), retrieved date Apr. 21, 2022.*
English translate (DE3609623A1), retrieved date Apr. 21, 2022.*
Fan Xiaobin et al.: "Rolling process and its influence analysis on hot continuous rolling mill vibration" Applied Physics A, Springer Berlin Heidelberg/Berlin, Nov. 9, 2016, vol. 122, No. 12.
International Search Report dated Oct. 23, 2019 for corresponding PCT patent application No. PCT/CN2019/097397.

* cited by examiner

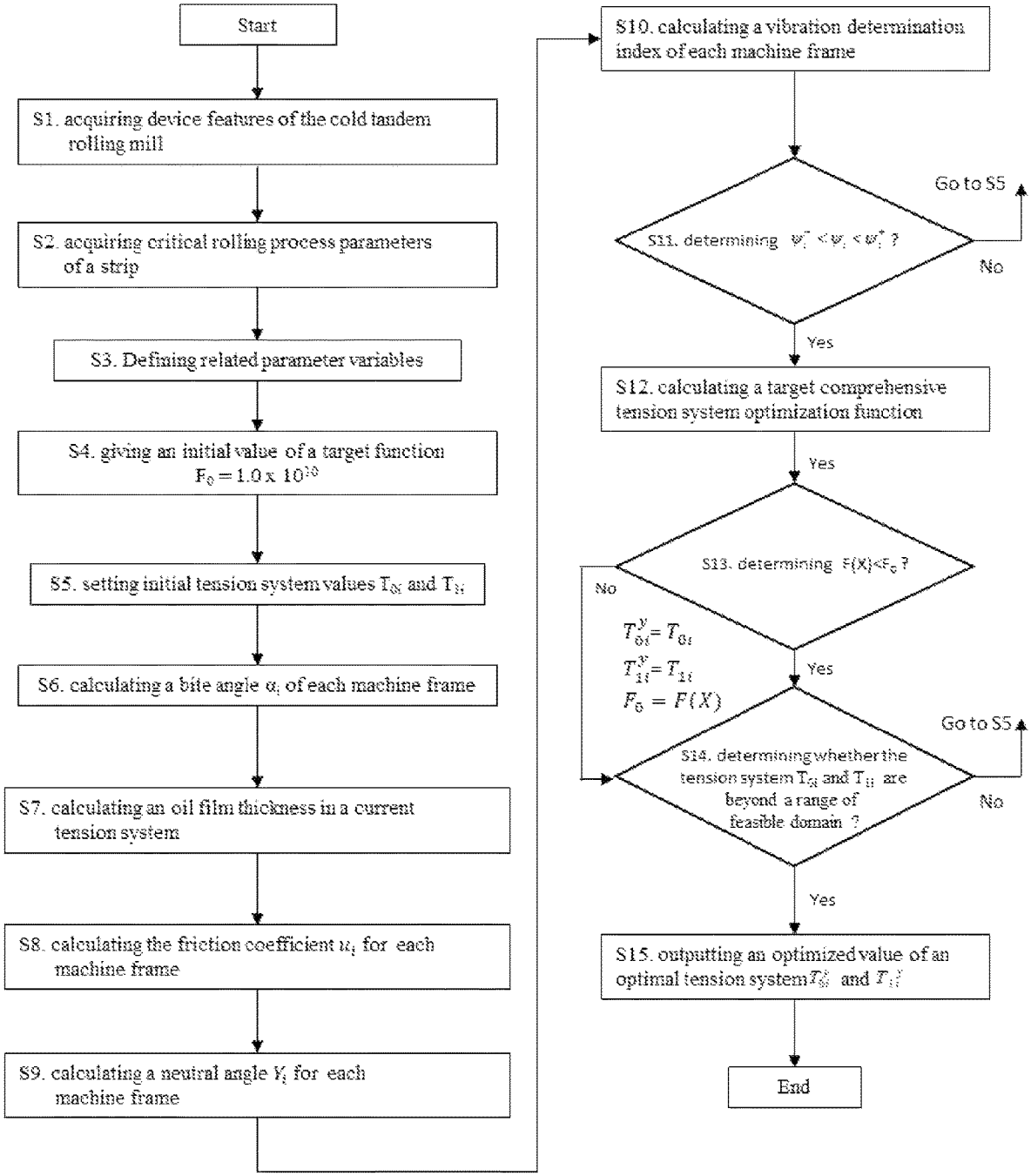
Start
S1. acquiring device features of the cold tandem rolling mill
S2. acquiring critical rolling process parameters of a strip
S3. Defining related parameter variables
S4. giving an initial value of a target function $F_0 = 1.0 \times 10^{10}$
S5. setting initial tension system values $T_{0i}$ and $T_{1i}$
S6. calculating a bite angle $\alpha_i$ of each machine frame
S7. calculating an oil film thickness in a current tension system
S8. calculating the friction coefficient $u_i$ for each machine frame
S9. calculating a neutral angle $\gamma_i$ for each machine frame
S10. calculating a vibration determination index of each machine frame
S11. determining $\psi_i^- < \psi_i < \psi_i^+$ ?
Go to S5
No
Yes
S12. calculating a target comprehensive tension system optimization function
Yes
S13. determining $F(X) < F_0$ ?
No
$T_{0i}^y = T_{0i}$
$T_{1i}^y = T_{1i}$
$F_0 = F(X)$
Yes
S14. determining whether the tension system $T_{0i}$ and $T_{1i}$ are beyond a range of feasible domain ?
Go to S5
No
Yes
S15. outputting an optimized value of an optimal tension system $T_{0i}^y$ and $T_{1i}^y$
End

TENSION SYSTEM OPTIMIZATION METHOD FOR SUPPRESSING VIBRATION OF COLD TANDEM ROLLING MILL

CROSS REFERENCE TO RELATED APPLICATIONS

This application is a national phase of PCT application No. PCT/CN2019/097397, filed Jul. 24, 2019, which claims priority to CN patent application No. 201810831304.0, filed Jul. 26, 2018, all of which are incorporated herein by reference thereto.

TECHNICAL FIELD

The present invention relates to the technical field of metallurgical steel rolling, and more particularly relates to a tension system optimization method for suppressing vibration of a cold tandem rolling mill.

BACKGROUND

In recent years, with the rapid development of automobile manufacturing, large ships, aerospace, and food packaging industries, the market demand for strips is increasingly enhanced. At the same time, downstream users' demand for high-precision and high-quality products promotes the development of large-scale and high-speed strip production device. In consideration of the complexity of strip production technology and production process, rolling mill vibration is often caused by the change of rolling conditions in a high-speed strip rolling process. Once the rolling mill vibration occurs, alternating light and dark stripes will be formed on the surface of strip steel, which will affect the surface quality of the strip steel. More seriously, damage to the rolling device is caused to result in on-site shutdown for maintenance, which greatly reduces the production efficiency of the strip production enterprise. Therefore, how to effectively solve the vibration problem of the cold tandem rolling mill in the high-speed process is the focus and difficulty in on-site technical research.

Patent 201410026171.1 provides a tension system optimization method for extremely thin strip rolling of a cold tandem rolling mill, wherein according to data, such as inlet tensile stress, exit tensile stress, deformation resistance, rolling speed, strip width, inlet thickness, exit thickness, and work roll diameter, of each machine frame, a slip factor, thermal scratch index, vibration coefficient, rolling force, and rolling power of each machine frame under current working conditions are calculated, while considering rolling stability, slip, thermal slip injury and vibration, in the case where the rolling capacity and rolling efficiency are taken into account, good exit strip shape of each machine frame is achieved. Finally, the optimization of the tension system is realized through computer program control. According to the above-mentioned patent, in the case of no slip, thermal slip injury and vibration during the rolling process of the cold tandem rolling mill, through the optimization of the tension system, the good shape of the output strip can be achieved. As the rolling mill vibration is only a constraint condition for the optimal tension system of the cold tandem rolling mill, no relevant technical solutions are given to solve the vibration problem in the high-speed rolling process of the cold tandem rolling mill.

SUMMARY

(1) Technical Problems Solved

The purpose of the present invention is to provide a tension system optimization method for suppressing vibration of a cold tandem rolling mill. By optimizing the tension system in the cold tandem rolling process, the problem of vibration in the high-speed rolling process of the cold tandem rolling mill can be controlled and suppressed, which plays an important role in improving the strip surface quality and improving the production efficiency of a strip production enterprise, and also brings economic benefits to the rolling mill.

(2) Technical Solution

A tension system optimization method for suppressing vibration of a cold tandem rolling mill, including the following steps.

S1. acquiring device feature parameters of the cold tandem rolling mill, including: a radius $R_i$ of a work roll of each machine frame, a surface linear speed $v_{ri}$ of a roll of each machine frame, original roughness $Ra_{ir,0}$ of the work roll of each machine frame, a roughness attenuation coefficient $B_{Li}$ of the work roll, and rolling distance in kilometer $L_i$ of the work roll of each machine frame after exchange of the roll, wherein, i=1, 2, . . . , n, representing the ordinal number of machine frames of the cold tandem rolling mill, and n is the total number of the machine frames;

S2. acquiring critical rolling process parameters of a strip, including: elastic modulus E of the strip, a Poisson's ratio ν of a strip, a strip width B, an inlet thickness $h_{0i}$ of the strip for each machine frame, an exit thickness $h_{1i}$ of the strip for each machine frame, a deformation resistance K of the strip, a rolling force $P_i$ of each machine frame, an inlet speed $v_{0i}$ of the strip in front of each machine frame, an influence coefficient $k_c$ of emulsion concentration, a viscosity compression coefficient θ of a lubricant, and dynamic viscosity $\eta_0$ of the lubricant;

S3. defining an upper threshold $\psi_i^+$ of a vibration determination index at an over-lubricated critical point at which a neutral angle coincides with and is equal to a bite angle, and at the moment, a friction coefficient is very small, and slippage between the work roll and the strip occurs easily, thereby causing the vibration of the rolling mill; defining a lower threshold $\psi_i^-$ of the vibration determination index at an under-lubricated critical point at which the neutral angle is half the bite angle, and at the moment, an oil film between the work roll and the strip is prone to rupture, thereby causing the friction coefficient to increase suddenly, resulting in abnormal rolling pressure fluctuations, and then causing the vibration of the rolling mill; and defining an inlet tension of each machine frame as $T_{0i}$, and an exit tension as $T_{1i}$, wherein $T_{01}=T_0$, $T_{1n}=T_1$;

S4. giving an initial set value of a target tension system optimization function for suppressing vibration of the cold tandem rolling mill: $F_0=1.0\times10^{10}$;

wherein S1 to S4 are not restricted in sequence;

S5. setting initial tension systems $T_{0i}$ and $T_{1i}$, $T_{0i+1}=T_{1i}$, wherein the initial tension systems can be 0. In practice, 0.3 times the hot rolling deformation resistance value is generally used as the initial tension system, and the maximum values of $T_{0i}$ and $T_{1i}$ are the maximum values allowed by the device. Optimal tension systems $T_{0i}^{y}$ and $T_{1i}^{y}$ are generally generated between 0.3 times and 0.6 times the hot rolling deformation resistance value.

S6. calculating a bite angle $\alpha_i$ of each machine frame, wherein a calculation formula is as follows:

$$\alpha_i = \sqrt{\frac{\Delta h_i}{R_i'}},$$

in the formula, $\Delta h_i = h_{0i} - h_{1i}$, $R_i'$ is a flattening radius of a work roll of the $i^{th}$ machine frame, and $$R_i' = R_i\left[1 + \frac{16(1-\nu^2)P_i}{\pi EB(h_{0i} - h_{1i})}\right];$$

S7. calculating an oil film thickness $\xi_i$ in a current tension system, wherein a calculation formula is as follows:

$$\xi_i = \frac{h_{0i} + h_{1i}}{2h_{0i}} \cdot k_c \cdot \frac{3\theta\eta_0(v_{ri} + v_{0i})}{\alpha_i\left[1 - e^{-\theta(K - T_{0i})}\right]} - k_{rg} \cdot (1 + K_{rs}) \cdot Ra_{ir0} \cdot e^{-B_{Li} \cdot L_i};$$

In the formula, $k_{rg}$ represents a coefficient of the strength of entrainment of lubricant by the longitudinal surface roughness of the work roll and the strip steel, and $K_{rs}$ represents an impression rate, i.e., a ratio of transferring the surface roughness of the work roll to the strip steel;

S8. calculating, according to the relationship between a friction coefficient $u_i$ and the oil film thickness $\xi_i$, a friction coefficient between the work roll of each machine frame and the strip steel: $u_i = a_i + b_i \cdot e^{B_i \cdot \xi_i}$, wherein $a_i$ is a liquid friction coefficient of the $i^{th}$ machine frame, $b_i$ is a dry friction coefficient of the $i^{th}$ machine frame, and $B_i$ is a friction factor attenuation index of the $i^{th}$ machine frame;

S9. calculating a neutral angle $\gamma_i$ of each machine frame in the current tension system according to the rolling theory, and a calculation formula is as follows:

$$\gamma_i = \frac{1}{2}\sqrt{\frac{\Delta h_i}{R_i'}}\left[1 - \frac{1}{2u_i}\left(\sqrt{\frac{\Delta h_i}{R_i'}} + \frac{T_{i0} - T_{i1}}{P_i}\right)\right];$$

S10. calculating a vibration determination index $\psi_i$ of each machine frame in the current tension system, wherein $$\psi_i = \frac{\gamma_i}{\alpha_i};$$

S11. determining whether inequalities $\psi_i^- < \psi_i < \psi_i^+$ are established; if yes, turning to step S12; otherwise, turning to step S5;

S12. calculating a target comprehensive tension system optimization function according to the following formula:

$$F(X) = \lambda\sqrt{\frac{\sum_{i=1}^{n}(\psi_i - \psi_{0i})^2}{n}} + (1-\lambda)\max|\psi_i - \psi_{0i}|,$$

in the formula, $\psi_{0i}$ is an optimal value of the vibration determination index, $$\psi_{0i} = \frac{\psi_i^+ + \psi_i^-}{2},$$

$\lambda$ is a distribution coefficient, and $X = \{T_{0i}, T_{1i}\}$ is an optimization variable.

S13. determining whether the inequality $F(X) < F_0$ is established; if yes, $T_{0i}^{y} = T_{0i}$, $T_{1i}^{y} = T_{1i}$, $F_0 = F(X)$, turning to step S14; otherwise, directly turning to step S14;

S14. determining whether the tension systems $T_{0i}$ and $T_{1i}$ are beyond a range of a feasible domain; if yes, turning to step S15; otherwise, turning to step S5, wherein the range of the feasible domain is from 0 to the maximum values of $T_{0i}$ and $T_{1i}$ allowed by a device. That is, the present invention calculates the target function F(X) by continuously repeating the S5-S14 on $T_{0i}$ and $T_{1i}$ within the range of the feasible domain, and $T_{0i}$ and $T_{1i}$ when the F(X) value is minimum are the optimal inlet tension $T_{0i}^{y}$ and the optimal exit tension $T_{0i}^{y}$;

S15. outputting a set value of an optimal tension system: the optimal inlet tension $T_{0i}^{y}$; and the optimal exit tension $T_{1i}^{y}$. In the present invention, as long as the execution of the next step is not based on the result of the previous step, there is no need to proceed according to the steps in sequence, unless the execution of the next step depends on the previous step.

According to an embodiment of the present invention, the value of $k_{rg}$ is in a range of 0.09 to 0.15.

According to an embodiment of the present invention, the value of $K_{rs}$ is in a range of 0.2 to 0.6.

According to an embodiment of the present invention, the upper threshold $\psi_i^+$ of the vibration determination index is $\psi_i^+ = 1$, the lower threshold $\psi_i^-$ of the vibration determination index is $\psi_i^- = ½$, and the optimal value of the vibration determination index is $\psi_{0i}$, $$\psi_{0i} = \frac{\psi_i^+ + \psi_i^-}{2} = \frac{3}{4}.$$

The value range of the above values is a better range obtained based on experimental experience.

(3) Beneficial Effects

The technical solution of a tension system optimization method for suppressing the vibration of the cold tandem rolling mill of the present invention is adopted, aiming at the vibration problem of the rolling mill during the high-speed rolling of the cold tandem rolling mill, the vibration determination index is defined to judge whether the rolling process of the cold tandem rolling mill is in a stable lubrication state without causing rolling mill vibration in the present invention, and based on this, the tension system optimization method for suppressing vibration of the cold tandem rolling mill is proposed, in combination with the device and process features of the cold tandem rolling mill, a suitable optimal value of the tension system is given, the high-speed and stable rolling process of the cold tandem rolling mill is ensured, the production efficiency of the strip production enterprise is improved, and the economic benefits of enterprises are improved; the present invention can be further popularized to other similar cold tandem rolling mills domestically, for optimization of the tension system for suppressing the vibration of the rolling mill during the high-speed rolling process of the cold tandem rolling mill, which has a broad prospect for popularization and application.

BRIEF DESCRIPTION OF THE DRAWINGS

In the present invention, the same reference numerals always indicate the same features, wherein:

FIG. 1 is a flow chart of a method of the present invention.

DETAILED DESCRIPTION OF THE EMBODIMENTS

The technical solution of the present invention will be further described below in conjunction with the drawings and embodiments.

During a rolling process of a cold tandem rolling mill, when a neutral angle is equal to a bite angle, a roll gap is in a over-lubricated critical state, and when the neutral angle is half the bite angle, the roll gap is in an under-lubricated critical state. Whether the roll gap is in the over-lubricated state or under-lubricated state, rolling mill vibration defects are caused. The tension system in the rolling process directly affects the lubrication state of each machine frame during the rolling process. Therefore, in order to control rolling mill vibration defects, the present invention starts from a tension system, optimizes a distribution of the tension system of the cold tandem rolling mill, realizes a coordinated control of a tension of each machine frame to ensure the best overall lubrication state of the cold tandem rolling mill and lubrication state of the individual machine frame, so that the rolling mill vibration defects can be controlled, and the surface quality of the finished strip steel of the cold tandem rolling mill and the stability of the rolling process can be improved.

With reference to FIG. 1, a tension system optimization method for suppressing vibration of a cold tandem rolling mill includes the following steps.

S1. Device feature parameters of the cold tandem rolling mill are acquired, including: a radius $R_i$ of a work roll of each machine frame, a surface linear speed $v_{ri}$ of a roll of each machine frame, original roughness $Ra_{ir,0}$ of the work roll of each machine frame, a roughness attenuation coefficient $B_{Li}$ of the work roll, and rolling distance in kilometer $L_i$ of the work roll of each machine frame after exchange of the roll, wherein, i=1, 2, . . . , n, representing the ordinal number of machine frames of the cold tandem rolling mill, and n is the total number of the machine frames.

S2. Critical rolling process parameters of a strip are acquired, including: elastic modulus E of the strip, a Poisson's ratio ν of the strip, a strip width B, an inlet thickness $h_{0i}$ of the strip for each machine frame, an exit thickness $h_{1i}$ of the strip for each machine frame, a deformation resistance K of the strip, a rolling force $P_i$ of each machine frame, an inlet speed $v_{0i}$ of the strip in front of each machine frame, an influence coefficient $k_c$ of emulsion concentration, a viscosity compression coefficient θ of a lubricant, and dynamic viscosity $\eta_0$ of the lubricant.

S3. An upper threshold $\psi_i^+$ of a vibration determination index is defined, at an over-lubricated critical point at which a neutral angle coincides with and is equal to a bite angle, and at the moment, a friction coefficient is very small, and slippage between the work roll and the strip occurs easily, thereby causing the vibration of a rolling mill; a lower threshold $\psi_i^-$ of the vibration determination index is defined, at an under-lubricated critical point at which the neutral angle is half the bite angle, and at the moment, an oil film between the work roll and the strip is prone to rupture, thereby causing the friction coefficient to increase suddenly, resulting in abnormal rolling pressure fluctuations, and then causing the vibration of the rolling mill; and an inlet tension of each machine frame is defined as $T_{0i}$, and an exit tension is defined as $T_{1i}$, wherein $T_{01}=T_0$, $T_{1n}=T_1$.

S4. An initial set value of a target tension system optimization function for suppressing vibration of a cold tandem rolling mill is given: $F_0=1.0\times10^{10}$.

wherein the S1 to S4 are not restricted in sequence and in some cases, the S1 to S4 can be executed simultaneously;

S5. Initial tension systems $T_{0i}$ and $T_{1i}$ are set, wherein $T_{0i+1}=T_{1i}$.

S6. A bite angle $\alpha_i$ of each machine frame is calculated, wherein a calculation formula is as follows:

$$\alpha_i = \sqrt{\frac{\Delta h_i}{R_i'}},$$

in the formula, $\Delta h_i=h_{0i}-h_{1i}$, $R_i'$ is a flattening radius of a work roll of the $i^{th}$ machine frame, and $$R_i' = R_i\left[1 + \frac{16(1-\nu^2)P_i}{\pi EB(h_{0i}-h_{1i})}\right].$$

S7. An oil film thickness $\xi_i$ in a current tension system is calculated, wherein a calculation formula is as follows:

$$\xi_i = \frac{h_{0i}+h_{1i}}{2h_{0i}}\cdot k_c\cdot\frac{3\theta\eta_0(v_{ri}+v_{0i})}{\alpha_i\left[1-e^{-\theta(K-T_{0i})}\right]} - k_{rg}\cdot(1+K_{rs})\cdot Ra_{ir0}\cdot e^{-B_{Li}\cdot L_i};$$

in the formula, $k_{rg}$ represents a coefficient of the strength of entrainment of lubricant by the longitudinal surface roughness of the work roll and the strip steel, and is in a range of 0.09 to 0.15, and $K_{rs}$ represents an impression rate, i.e., a ratio of transferring the surface roughness of the work roll to the strip steel, and is in a range of 0.2 to 0.6.

S8. According to the relationship between the friction coefficient $u_i$ and the oil film thickness $\xi_i$, a friction coefficient between the work roll of each machine frame and the strip steel is calculated: $u_i=a_i+b_i\cdot e^{B_i\cdot\xi_i}$, wherein $a_i$ is a liquid friction coefficient of the $i^{th}$ machine frame, $b_i$ is a dry friction coefficient of the $i^{th}$ machine frame, and $B_i$ is a friction factor attenuation index of the $i^{th}$ machine frame.

S9. A neutral angle $\gamma_i$ of each machine frame in the current tension system is calculated according to the rolling theory, and a calculation formula is as follows:

$$\gamma_i = \frac{1}{2}\sqrt{\frac{\Delta h_i}{R_i'}}\left[1-\frac{1}{2u_i}\left(\sqrt{\frac{\Delta h_i}{R_i'}}+\frac{T_{i0}-T_{i1}}{P_i}\right)\right].$$

S10. A vibration determination index $\psi_i$ of each machine frame in the current tension system is calculated.

S11. It is determined whether inequalities $\psi_i^-<\psi_i<\psi_i^+$ are established simultaneously; if yes, turning to step S12; otherwise, turning to step S5.

S12. A target comprehensive tension system optimization function is calculated according to the following formula:

$$F(X) = \lambda\sqrt{\frac{\sum_{i=1}^{n}(\psi_i - \psi_{0i})^2}{n}} + (1-\lambda)\max|\psi_i - \psi_{0i}|,$$

in the formula, $\psi_{0i}$ is an optimal value of the vibration determination index, $$\psi_{0i} = \frac{\psi_i^+ + \psi_i^-}{2},$$

$\lambda$ is a distribution coefficient, $X=\{T_{0i},T_{1i}\}$ is an optimization variable, and the calculated value of F(X) is a maximum rolling mill vibration determination index coefficient value of each individual machine frame.

S13. It is determined whether an inequality $F(X)<F_0$ is established; if yes, $T_{0i}^y=T_{0i}$, $T_{1i}^y=T_{1i}$, $F_0=F(X)$, turning to step S14; otherwise, directly turning to step S14.

S14. It is determined whether the tension systems $T_{0i}$ and $T_{1i}$ are beyond a range of a feasible domain; if yes, turning to step S15; otherwise, turning to step S5; the range of the feasible domain is from 0 to a maximum value of $T_{0i}$ and $T_{1i}$ allowed by the device.

S15. A set value of an optimal tension system is output: the optimal inlet tension $T_{0i}^y$; and the optimal exit tension $T_{1i}^y$, wherein the $T_{0i}^y$ and $T_{1i}^y$ respectively are the $T_{0i}$ and $T_{1i}$ when the value of F(X) calculated in the range of the feasible domain is minimum, that is, $T_{0i}$ and $T_{1i}$ when F(X) is minimum are used as $T_{0i}^y$ and $T_{1i}^y$.

Embodiment 1

S1. Device feature parameters of the cold tandem rolling mill are acquired, including: a radius $R_i$={1 #217.5; 2 #217.5; 3 #217.5; 4 #217.5; 5 #217.5} (mm) of a work roll of each machine frame (5 machine frames), a surface linear speed $v_{ri}$={1 #149.6; 2 #292.3; 3 #328.3; 4 #449.2; 5 #585.5} (m/min) of a roll of each machine frame (5 machine frames), original roughness $Ra_{ir,0}$={1 #0.53; 2 #0.53; 3 #0.53; 4 #0.53; 5 #0.53} (μm) of the work roll of each machine frame (5 machine frames), a roughness attenuation coefficient $B_{Li}$={1 #0.01; 2 #0.0.1; 3 #0.01; 4 #0.01; 5 #0.01} of the work roll of each machine frame (5 machine frames), and rolling distance in kilometer $L_i$={1 #200; 2 #180; 3 #190; 4 #220; 5 #250} (km) of the work roll of each machine frame (5 machine frames) after exchange of the roll, wherein i=1, 2, . . . , 5, representing the ordinal number of machine frames of the cold tandem rolling mill, and in all embodiments of the present application, the number before "#" refers to i, that is, the $i^{th}$ machine frame, and the corresponding parameters are after "#".

S2. Critical rolling process parameters of a strip are acquired, including: elastic modulus E=206 GPa of a strip, a Poisson's ratio ν=0.3 of the strip, a strip width B=812 mm, an inlet thickness $h_{0i}$={1 #2.1; 2 #1.17; 3 #0.65; 4 #0.4; 5 #0.27} (mm) of the strip for each machine frame (5 machine frames), an exit thickness $h_{1i}$={1 #1.17; 2 #0.65; 3 #0.40; 4 #0.27; 5 #0.22} (mm) of the strip for each machine frame (5 machine frames), a deformation resistance K=502 MPa of the strip, a rolling force $P_i$={1 #507.9; 2 #505.4; 3 #499.8; 4 #489.8; 5 #487.2} (t) of each machine frame, an inlet speed $v_{0i}$={1 #147.6; 2 #288.2; 3 #323.3; 4 #442.0; 5 #575.5} (m/min) of the strip in front of each machine frame (5 machine frames), an influence coefficient $k_c$=0.9 of emulsion concentration, a viscosity compression coefficient $\theta$=0.034 $m^2/N$ of a lubricant, and dynamic viscosity $\eta_0$=5.4 of the lubricant.

S3. An upper threshold $\psi_i^+$=1 of a vibration determination index is defined, at an over-lubricated critical point at which a neutral angle coincides with and is equal to a bite angle, and at the moment, a friction coefficient is very small, and slippage between the work roll and the strip occurs easily, thereby causing the vibration of a rolling mill; a lower threshold $\psi_i^-$=½ of the vibration determination index is defined, at an under-lubricated critical point at which the neutral angle is half the bite angle, and at the moment, an oil film between the work roll and the strip is prone to rupture, thereby causing the friction coefficient to increase suddenly, resulting in abnormal rolling pressure fluctuations, and then causing the vibration of the rolling mill; and an inlet tension of each machine frame is defined as $T_{0i}$, and an exit tension is defined as $T_{1i}$, wherein $T_{01}=T_0$, $T_{1n}=T_1$.

S4. An initial set value of a depressing schedule target comprehensive optimization function for suppressing vibration of a cold tandem rolling mill is given: $F_0=1.0\times10^{10}$.

S5. Initial tension systems $$T_{0i} = \{1\#100.0;\ 2\#80.0;\ 3\#65.0;\ 4\#55;\ 5\#42\}MPa$$

$$T_{1i} = \{1\#80.0;\ 2\#65.0;\ 3\#55.0;\ 4\#42;\ 5\#18\}MPa$$

of each machine frame (5 machine frames) are set, wherein $T_{0i+1}=T_{1i}$ i=1, 2 . . . 5.

S6. A bite angle $\alpha_i$ of each machine frame is calculated, wherein a calculation formula is as follows:

$$\alpha_i = \sqrt{\frac{\Delta h_i}{R_i'}},$$

wherein $\Delta h_i=h_{0i}-h_{1i}$, $\alpha_i$={1 #0.004; 2 #0.002; 3 #0.001; 4 #0.0005; 5 #0.0002}, $R_i'$ is a flattening radius of a work roll of the $i^{th}$ machine frame, $$R_i' = R_i\left[1 + \frac{16(1-\nu^2)P_i}{\pi EB(h_{0i}-h_{1i})}\right]$$

and $R_i'$={1 #217.8; 2 #224.5; 3 #235.6; 4 #260.3; 5 #275.4} (mm).

S7. An oil film thickness $\xi_i$ in a current tension system is calculated, wherein a calculation formula is as follows:

$$\xi_i = \frac{h_{0i}+h_{1i}}{2h_{0i}}\cdot k_c\cdot\frac{3\theta\eta_0(v_{ri}+v_{0i})}{\alpha_i[1-e^{-\theta(K-T_{0i})}]} - k_{rg}\cdot(1+K_{rs})\cdot Ra_{ir0}\cdot e^{-B_{Li}\cdot L_i}$$

$$\xi_i = \{1\#0.1;\ 2\#0.25;\ 3\#0.34;\ 4\#0.55;\ 5\#0.67\}(\mu m),$$

in the formula, $k_{rg}$ represents a strength coefficient of the lubricant entrained by the longitudinal roughness of the work roll and a strip steel, and is in a range of 0.09 to 0.15, and $K_{rs}$ represents an impression rate, i.e., a ratio of transferring the surface roughness of the work roll to the strip steel, and is in a range of 0.2 to 0.6.

S8. According to the relationship between the friction coefficient $u_i$ and the oil film thickness $\xi_i$, a friction coefficient between the work roll of each machine frame and the strip steel is calculated: $u_i=a_i+b_i\cdot e^{B_i\cdot\xi_i}$, $u_i=\{1\ \#0.124;\ 2\ \#0.089;\ 3\ \#0.078;\ 4\ \#0.047;\ 5\ \#0.042\}$, wherein $a_i$ is a liquid friction coefficient of the $i^{th}$ machine frame, $a_i=\{1\ \#0.0126;\ 2\ \#0.0129;\ 3\ \#0.0122;\ 4\ \#0.0130;\ 5\ \#0.0142\}$, $b_i$ is a dry friction coefficient of the $i^{th}$ machine frame, $b_i=\{1\ \#0.1416;\ 2\ \#0.1424;\ 3\ \#0.1450;\ 4\ \#0.1464;\ 5\ \#0.1520\}$, and $B_i$ is a friction factor attenuation index of the $i^{th}$ machine frame, $B_i=\{1\ \#-2.4;\ 2\ \#-2.51;\ 3\ \#-2.33;\ 4\ \#-2.64;\ 5\ \#-2.58\}$.

S9. A neutral angle $\gamma_i$ of each machine frame in the current tension system is calculated according to the rolling theory, and a calculation formula is as follows:

$$\gamma_i = \frac{1}{2}\sqrt{\frac{\Delta h_i}{R_i'}}\left[1-\frac{1}{2u_i}\left(\sqrt{\frac{\Delta h_i}{R_i'}}+\frac{T_{i0}\cdot B\cdot h_{0i}-T_{i1}B\cdot h_{1i}}{P_i}\right)\right],$$

$$\gamma_i = \{1\#0.0025;\ 2\#0.0012;\ 3\#0.0006;\ 4\#0.0003;\ 5\#0.00014\}.$$

S10. A vibration determination index $\psi_i=\{1\ \#0.625;\ 2\ \#0.6;\ 3\ \#0.6;\ 4\ \#0.6;\ 5\ \#0.7\}$ of each machine frame in the current tension system is calculated according to $$\psi_i = \frac{\gamma_i}{\alpha_i}.$$

S11. It is determined whether inequalities $\psi_i^-<\psi_i<\psi_i^+$ are established simultaneously; if yes, turning to step S12.

S12. A comprehensive optimization target function of the tension system is calculated:

$$F(X) = \lambda\sqrt{\frac{\sum_{i=1}^{n}(\psi_i-\psi_{0i})^2}{n}} + (1-\lambda)\max|\psi_i-\psi_{0i}|,$$

$$F(X) = 0.231,$$

in the formula, $$\psi_{0i} = \frac{\psi_i^+ + \psi_i^-}{2} = \frac{3}{4},$$

$\lambda$ is a distribution coefficient, $\lambda=0.5$, and $X=\{T_{0i},T_{1i}\}$ is an optimization variable.

S13. It is determined whether inequality $F(X)<F_0$ is established; if yes, $T_{0i}^y=T_{0i}$, $T_{1i}^y=T_{1i}$, $F_0=F(X)$, turning to step S14; otherwise, directly turning to step S14.

S14. It is determined whether the tension systems $T_{0i}$ and $T_{1i}$ are beyond a range of a feasible domain; if yes, turning to step S15, that is, the S5-S14 are continuously repeated for all data of $T_{0i}$ and $T_{1i}$ in the range of the feasible domain, calculated F(X) values are compared, and $T_{0i}$ and $T_{1i}$ when F(X) is minimum are selected.

S15. A set value of an optimal tension system is output, wherein $T_{0i}^y=\{1\ \#85;\ 2\ \#70\ \#;\ 3\ \#55;\ 4\ \#50;\ 5\ \#45\}$ MPa; $T_{1i}^y=\{1\ \#70;\ 2\ \#55\ \#;\ 3\ \#50;\ 4\ \#45;\ 5\ \#40\}$ MPa.

The $T_{0i}^y$ and $T_{1i}^y$ are values of $T_{0i}$ and $T_{1i}$ when the F(X) value calculated in the S14 is minimum.

Embodiment 2

S1. Device feature parameters of the cold tandem rolling mill are acquired, including: a radius $R_i=\{1\ \#217.5;\ 2\ \#217.5;\ 3\ \#217.5;\ 4\ \#217.5;\ 5\ \#217.5\}$ (mm) of a work roll of each machine frame (5 machine frames), a surface linear speed $v_{ri}=\{1\ \#149.6;\ 2\ \#292.3;\ 3\ \#328.3;\ 4\ \#449.2;\ 5\ \#585.5\}$ (m/min) of a roll of each machine frame (5 machine frames), original roughness $Ra_{ir,0}=\{1\ \#0.53;\ 2\ \#0.53;\ 3\ \#0.53;\ 4\ \#0.53;\ 5\ \#0.53\}$ (μm) of the work roll of each machine frame (5 machine frames), a roughness attenuation coefficient $B_{Li}=\{1\ \#0.01;\ 2\ \#0.0.1;\ 3\ \#0.01;\ 4\ \#0.01;\ 5\ \#0.01\}$ of the work roll of each machine frame (5 machine frames), and rolling distance in kilometer $L_i=\{1\ \#220;\ 2\ \#190;\ 3\ \#200;\ 4\ \#240;\ 5\ \#260\}$ (km) of the work roll of each machine frame (5 machine frames) after exchange of the roll, wherein i=1, 2, . . . , 5, representing the ordinal number of machine frames of the cold tandem rolling mill.

S2. Critical rolling process parameters of a strip are acquired, including: elastic modulus E=210 GPa of a strip, a Poisson's ratio $\nu=0.3$ of the strip, a strip width B=826 mm, an inlet thickness $k_{0i}=\{1\ \#22;\ 2\ \#1.27;\ 3\ \#0.75;\ 4\ \#0.5;\ 5\ \#0.37\}$ (mm) of the strip for each machine frame (5 machine frames), an exit thickness $h_{1i}=\{1\ \#1.27;\ 2\ \#0.75;\ 3\ \#0.50;\ 4\ \#0.37;\ 5\ \#0.32\}$ (mm) of the strip for each machine frame (5 machine frames), a deformation resistance K=510 MPa of the strip, a rolling force $P_i=\{1\ \#517.9;\ 2\ \#508.4;\ 3\ \#502.8;\ 4\ \#495.8;\ 5\ \#490.2\}$ (t) of each machine frame, an inlet speed $v_{0i}=\{1\ \#137.6;\ 2\ \#276.2;\ 3\ \#318.3;\ 4\ \#438.0;\ 5\ \#568.5\}$ (m/min) of the strip in front of each machine frame (5 machine frames), an influence coefficient $k_c=0.9$ of emulsion concentration, a viscosity compression coefficient $\theta=0.034\ m^2/N$ of a lubricant, and dynamic viscosity $\eta_0=5.4$ of the lubricant.

S3. An upper threshold $\psi_i^+=1$ of a vibration determination index is defined, at an over-lubricated critical point at which a neutral angle coincides with and is equal to a bite angle, at the moment, a friction coefficient is very small, and slippage between the work roll and the strip occurs easily, thereby causing the vibration of a rolling mill; a lower threshold $\psi_i^-=1/2$ of the vibration determination index is defined, at an under-lubricated critical point at which the neutral angle is half the bite angle, at the moment, an oil film between the work roll and the strip is prone to rupture, thereby causing the friction coefficient to increase suddenly, resulting in abnormal rolling pressure fluctuations, and then causing the vibration of the rolling mill; and an inlet tension of each machine frame is defined as $T_{0i}$, and an exit tension is defined as $T_{1i}$, wherein $T_{01}=T_0$, $T_{1n}=T_1$.

S4. An initial set value of a depressing schedule target comprehensive optimization function for suppressing vibration of the cold tandem rolling mill is given: $F_0=1.0\times10^{10}$.

S5. Initial tension systems $$T_{0i} = \{1\#120.0;\ 2\#90.0;\ 3\#69.0;\ 4\#65;\ 5\#49\}MPa$$

$$T_{1i} = \{1\#90.0;\ 2\#69.0;\ 3\#65.0;\ 4\#49;\ 5\#20\}MPa$$

of each machine frame (5 machine frames) are set, wherein $T_{0i+1}=T_{1i}$ i=1, 2 . . . 5.

S6. A bite angle $\alpha_i$ of each machine frame is calculated, wherein a calculation formula is as follows:

$$\alpha_i = \sqrt{\frac{\Delta h_i}{R_i'}},$$

$\alpha_i$={1 #0.003; 2 #0.0025; 3 #0.001; 4 #0.0004; 5 #0.0001} in the formula, $\Delta h_i = h_{0i} - h_{1i}$, $R_i'$ is a flattening radius of a work roll of the $i^{th}$ machine frame, $$R_i' = R_i\left[1 + \frac{16(1-\nu^2)P_i}{\pi EB(h_{0i} - h_{1i})}\right]$$

and $R_i'$={1 #219.8; 2 #228.7; 3 #237.4; 4 #262.5; 5 #278.6} (mm).

S7. An oil film thickness $\xi_i$ in a current tension system is calculated, wherein a calculation formula is as follows:

$$\xi_i = \frac{h_{0i} + h_{1i}}{2h_{0i}} \cdot k_c \cdot \frac{3\theta\eta_0(v_{ri} + v_{0i})}{\alpha_i[1 - e^{-\theta(K - T_{0i})}]} - k_{rg} \cdot (1 + K_{rs}) \cdot Ra_{ir0} \cdot e^{-B_{Li} \cdot L_i},$$

$$\xi_i = \{1\#0.15;\ 2\#0.3;\ 3\#0.38;\ 4\#0.60;\ 5\#0.69\}(\mu m)$$

in the formula, $k_{rg}$ represents a coefficient of the strength of entrainment of lubricant by the longitudinal surface roughness of the work roll and the strip steel, and is in a range of 0.09 to 0.15, and $K_{rs}$ represents an impression rate, i.e., a ratio of transferring the surface roughness of the work roll to the strip steel, and is in a range of 0.2 to 0.6.

S8. According to the relationship between a friction coefficient $u_i$ and the oil film thickness $\xi_i$, a friction coefficient between the work roll of each machine frame and the strip steel is calculated: $u_i = a_i + b_i \cdot e^{B_i \cdot \xi_i}$, $u_i$={1 #0.135; 2 #0.082; 3 #0.085; 4 #0.053; 5 #0.047}, wherein $a_i$ is a liquid friction coefficient of the $i^{th}$ machine frame, $a_i$={1 #0.0126; 2 #0.0129; 3 #0.0122; 4 #0.0130; 5 #0.0142}, $b_i$ is a dry friction coefficient of the $i^{th}$ machine frame, $b_i$={1 #0.1416; 2 #0.1424; 3 #0.1450; 4 #0.1464; 5 #0.1520}, and $B_i$ is a friction factor attenuation index of the $i^{th}$ machine frame, $B_i$={1 #−2.4; 2 #−2.51; 3 #−2.33; 4 #−2.64; 5 #−2.58}.

S9. A neutral angle $\gamma_i$ of each machine frame in the current tension system is calculated according to the rolling theory, and a calculation formula is as follows:

$$\gamma_i = \frac{1}{2}\sqrt{\frac{\Delta h_i}{R_i'}}\left[1 - \frac{1}{2u_i}\left(\sqrt{\frac{\Delta h_i}{R_i'}} + \frac{T_{i0} \cdot B \cdot h_{0i} - T_{i1} B \cdot h_{1i}}{P_i}\right)\right],$$

$$\gamma_i = \{1\#0.0025;\ 2\#0.0012;\ 3\#0.0008;\ 4\#0.0006;\ 5\#0.00023\}.$$

S10. A vibration determination index $\psi_i$={1 #0.833; 2 #0.48; 3 #0.8; 4 #0.6; 5 #0.23} of each machine frame in the current tension system is calculated according to $$\psi_i = \frac{\gamma_i}{\alpha_i}.$$

S11. It is determined whether inequalities $\psi_i^- < \psi_i < \psi_i^+$ are established simultaneously; if yes, turning to step S12.

S12. A target comprehensive tension system optimization function is calculated:

$$F(X) = \lambda\sqrt{\frac{\sum_{i=1}^{n}(\psi_i - \psi_{0i})^2}{n}} + (1-\lambda)\max|\psi_i - \psi_{0i}|,$$

-continued $$F(X) = 0.325,$$

in the formula, $$\psi_{0i} = \frac{\psi_i^+ + \psi_i^-}{2} = \frac{3}{4},$$

$\lambda$ is a distribution coefficient, $\lambda$=0.5, and X={$T_{0i}$,$T_{1i}$} is an optimization variable.

S13. It is determined whether inequality $F(X) < F_0$ is established; if yes, $T_{0i}^y = T_{0i}$, $T_{1i}^y = T_{1i}$, $F_0 = F(X)$, turning to step S14; otherwise, directly turning to step S14.

S14. It is determined whether the tension systems $T_{0i}$ and $T_{1i}$ are beyond a range of a feasible domain; if yes, turning to step S15, that is, the S5-S14 are continuously repeated for all data of $T_{0i}$ and $T_{1i}$ in the range of the feasible domain, calculated F(X) values are compared, and $T_{0i}$ and $T_{1i}$ when F(X) is minimum are selected.

S15. A set value of an optimal tension system is output, wherein $T_{0i}^y$={1 #90; 2 #75 #; 3 #60; 4 #55; 5 #50} MPa; $T_{1i}^y$={1 #75; 2 #60 #; 3 #50; 4 #50; 5 #45} MPa. The $T_{0i}^y$ and $T_{1i}^y$ are the $T_{0i}$ and $T_{1i}$ when the F(X) value calculated in the S14 is minimum.

Embodiment 3

S1. Device feature parameters of the cold tandem rolling mill are acquired, including: a radius $R_i$={1 #217.5; 2 #217.5; 3 #217.5; 4 #217.5; 5 #217.5} (mm) of a work roll of each machine frame (5 machine frames), a surface linear speed $v_{ri}$={1 #149.6; 2 #292.3; 3 #328.3; 4 #449.2; 5 #585.5} (m/min) of a roll of each machine frame (5 machine frames), original roughness $Ra_{ir,0}$={1 #0.53; 2 #0.53; 3 #0.53; 4 #0.53; 5 #0.53} (μm) of the work roll of each machine frame (5 machine frames), a roughness attenuation coefficient $B_{Li}$={1 #0.01; 2 #0.0.1; 3 #0.01; 4 #0.01; 5 #0.01} of the work roll of each machine frame (5 machine frames), and rolling distance in kilometer $L_i$={1 #190; 2 #170; 3 #180; 4 #210; 5 #230} (km) of the work roll of each machine frame (5 machine frames) after exchange of the roll, wherein, i=1, 2, . . . , 5, representing the ordinal number of machine frames of the cold tandem rolling mill.

S2. Critical rolling process parameters of a strip are acquired, including: elastic modulus E=201 GPa of the strip, a Poisson's ratio $\nu$=0.3 of the strip, a strip width B=798 mm, an inlet thickness $h_{0i}$={1 #2.0; 2 #1.01; 3 #0.55; 4 #0.35; 5 #0.25} (mm) of the strip for each machine frame (5 machine frames), an exit thickness $h_{1i}$={1 #1.01; 2 #0.55; 3 #0.35; 4 #0.25; 5 #0.19} (mm) of the strip for each machine frame (5 machine frames), a deformation resistance K=498 MPa of the strip, a rolling force $P_i$={1 #526.9; 2 #525.4; 3 #502.3; 4 #496.5; 5 #493.4} (t) of each machine frame, an inlet speed $v_{0i}$={1 #159.5; 2 #296.3; 3 #335.4; 4 #448.0; 5 #586.3} (m/min) of the strip in front of each machine frame (5 machine frames), an influence coefficient $k_c$=0.9 of emulsion concentration, a viscosity compression coefficient $\theta$=0.034 $m^2$/N of a lubricant, and dynamic viscosity $\eta_0$=5.4 of the lubricant.

S3. An upper threshold $\omega_i^+$=1 of a vibration determination index is defined, at an over-lubricated critical point at which a neutral angle coincides with and is equal to a bite angle, at the moment, a friction coefficient is very small, and slippage between the work roll and the strip occurs easily, thereby causing the vibration of a rolling mill; a lower threshold $\psi_i^-=½$ of the vibration determination index is defined, at an under-lubricated critical point at which the neutral angle is half the bite angle, at the moment, an oil film between the work roll and the strip is prone to rupture, thereby causing the friction coefficient to increase suddenly, resulting in abnormal rolling pressure fluctuations, and then causing the vibration of the rolling mill; and an inlet tension of each machine frame is defined as $T_{0i}$, and an exit tension is defined as $T_{1i}$, wherein $T_{01}=T_0$, $T_{1n}=T_1$.

S4. An initial set value $F_0=1.0\times10^{10}$ of a depressing schedule target comprehensive optimization function for suppressing vibration of the cold tandem rolling mill is given.

S5. Initial tension systems $$T_{0i} = \{1\#100.0;\ 2\#75.0;\ 3\#60.0;\ 4\#50;\ 5\#36\}MPa$$

$$T_{1i} = \{1\#75.0;\ 2\#60.0;\ 3\#50.0;\ 4\#36;\ 5\#17\}MPa$$

of each machine frame (5 machine frames) are set, wherein $T_{0i+1}=T_{1i}$ i=1, 2 . . . 5.

S6. A bite angle $\alpha_i$ of each machine frame is calculated, wherein a calculation formula is as follows:

$$\alpha_i = \sqrt{\frac{\Delta h_i}{R_i'}},$$

$\Delta h_i=h_{0i}-h_{1i}$, $\alpha_i=\{1\ \#0.005;\ 2\ \#0.004;\ 3\ \#0.002;\ 4\ \#0.0008;\ 5\ \#0.0003\}$, in the formula, $R_i'$ is a flattening radius of a work roll of the $i^{th}$ machine frame, $$R_i' = R_i\left[1 + \frac{16(1-v^2)P_i}{\pi EB(h_{0i}-h_{1i})}\right]$$

and $R_i'=\{1\ \#209.3;\ 2\ \#221.7;\ 3\ \#232.8;\ 4\ \#254.6;\ 5\ \#272.1\}$ (mm).

S7. An oil film thickness $\xi_i$ in a current tension system is calculated, wherein a calculation formula is as follows:

$$\xi_i = \frac{h_{0i}+h_{1i}}{2h_{0i}}\cdot k_c\cdot\frac{3\theta\eta_0(v_{ri}+v_{0i})}{\alpha_i[1-e^{-\theta(K-T_{0i})}]} - k_{rg}\cdot(1+K_{rs})\cdot Ra_{ir0}\cdot e^{-B_{Li}\cdot L_i}$$

$$\xi_i = \{1\#0.15;\ 2\#0.3;\ 3\#0.29;\ 4\#0.51;\ 5\#0.66\}(\mu m),$$

in the formula, $k_{rg}$ represents a coefficient of the strength of entrainment of lubricant by the longitudinal surface roughness of the work roll and the strip steel, and is in a range of 0.09 to 0.15, and $K_{rs}$ represents an impression rate, i.e., a ratio of transferring the surface roughness of the work roll to the strip steel, and is in a range of 0.2 to 0.6.

S8. According to the relationship between a friction coefficient $u_i$ and the oil film thickness $\xi_i$, a friction coefficient between the work roll of each machine frame and the strip steel is calculated: $u_i=a_i+b_i\cdot e^{B_i\cdot\xi_i}$, $u_i=\{1\ \#0.115;\ 2\ \#0.082;\ 3\ \#0.071;\ 4\ \#0.042;\ 5\ \#0.039\}$, wherein $a_i$ is a liquid friction coefficient of the $i^{th}$ machine frame, $\alpha_i=\{1\ \#0.0126;\ 2\ \#0.0129;\ 3\ \#0.0122;\ 4\ \#0.0130;\ 5\ \#0.0142\}$ $b_i$ is a dry friction coefficient of the $i^{th}$ machine frame, $b_i=\{1\ \#0.1416;\ 2\ \#0.1424;\ 3\ \#0.1450;\ 4\ \#0.1464;\ 5\ \#0.1520\}$, and $B_i$ is a friction factor attenuation index of the $i^{th}$ machine frame, $B_i=\{1\ \#-2.4;\ 2\ \#-2.51;\ 3\ \#-2.33;\ 4\ \#-2.64;\ 5\ \#-2.58\}$.

S9. A neutral angle $\gamma_i$ of each machine frame in the current tension system is calculated according to the rolling theory, and a calculation formula is as follows:

$$\gamma_i = \frac{1}{2}\sqrt{\frac{\Delta h_i}{R_i'}}\left[1 - \frac{1}{2u_i}\left(\sqrt{\frac{\Delta h_i}{R_i'}} + \frac{T_{i0}\cdot B\cdot h_{0i} - T_{i1}B\cdot h_{1i}}{P_i}\right)\right],$$

$$\gamma_i = \{1\#0.0035;\ 2\#0.0022;\ 3\#0.0008;\ 4\#0.0004;\ 5\#0.00018\}.$$

S10. A vibration determination index $\psi_i=\{1\ \#0.7;\ 2\ \#0.55;\ 3\ \#0.4;\ 4\ \#0.5;\ 5\ \#0.6\}$ of each machine frame in the current tension system is calculated according to $$\psi_i = \frac{\gamma_i}{\alpha_i}.$$

S11. It is determined whether inequalities $\psi_i^-<\psi_i<\psi_i^+$ are established simultaneously; if yes, turning to step S12.

S12. A target comprehensive tension system optimization function is calculated:

$$F(X) = \lambda\sqrt{\frac{\sum_{i=1}^{n}(\psi_i-\psi_{0i})^2}{n}} + (1-\lambda)\max|\psi_i-\psi_{0i}|,$$

$$F(X) = 0.277,$$

in the formula, $$\psi_{0i} = \frac{\psi_i^+ + \psi_i^-}{2} = \frac{3}{4},$$

$\lambda$ is a distribution coefficient, $\lambda=0.5$ and $X=\{T_{0i},T_{1i}\}$ is an optimization variable.

S13. It is determined whether an inequality $F(X)<F_0$ is established; if yes, $T_{0i}^y=T_{0i}$, $T_{1i}^y=T_{1i}$, $F_0=F(X)$, turning to step S14; otherwise, directly turning to step S14.

S14. It is determined whether tension systems $T_{0i}$, and $T_{1i}$ are beyond a range of a feasible domain; if yes, turning to step S15, that is, the S5-S14 are continuously repeated for all data of $T_{0i}$ and $T_{1i}$ in the range of the feasible domain, calculated F(X) values are compared, and $T_{0i}$ and $T_{1i}$ when the F(X) value is the minimum are selected.

S15. A set value of an optimal tension system is output, wherein $T_{0i}^y=\{1\ \#80;\ 2\ \#65\ \#;\ 3\ \#50;\ 4\ \#45;\ 5\ \#40\}$ MPa; $T_{1i}^y=\{1\ \#65;\ 2\ \#50\ \#;\ 3\ \#45;\ 4\ \#40;\ 5\ \#35\}$ MPa. The $T_{0i}^y$ and $T_{1i}^y$ are the $T_{0i}$ and $T_{1i}$ when the F(X) value calculated in the S14 is minimum.

In summary, the technical solution of the tension system optimization method for suppressing the vibration of the cold tandem rolling mill of the present invention is adopted, aiming at the vibration problem of the rolling mill during the high-speed rolling of the cold tandem rolling mill, the vibration determination index is defined to judge whether the rolling process of the cold tandem rolling mill is in a stable lubrication state without causing rolling mill vibration in the present invention, and based on this, a tension system optimization method for suppressing vibration of the cold tandem rolling mill is proposed, in combination with the device and process features of the cold tandem rolling mill, an objective is employed such that the vibration determination indexes of the machine frames are closest to the optimal value $$\psi_{0i} = \frac{\psi_i^+ + \psi_i^-}{2}$$

of the vibration determination index, a mean square error between the comprehensive optimization target function of the tension system and the vibration determination index $\psi_i$ of each machine frame acquired in an actual rolling process is at a minimum, and a maximum value of the rolling machine vibration determination index coefficient F(X) of each individual machine frame is also at a minimum, a constraint in which the upper threshold $\psi_i^+$ of the vibration determination index is acquired during the rolling process at the over-lubricated state in which the neutral angle $\gamma_i$ coincides with the bite angle $\alpha_i$ and a constraint in which the lower threshold $\psi_i^-$ of the vibration determination index is acquired during the rolling process at the under-lubricated state in which the neutral angle $\gamma_i$ is half the bite angle $\alpha_i$ are employed, the optimization calculation of the tension system in the range of the feasible domain is performed, and the appropriate optimized values $T_{0i}^y$ and $T_{1i}^y$ of the tension system are finally given. Through the actual application on site, the problem of rolling mill vibration defects is effectively suppressed, the probability of vibration is greatly reduced, and at the same time, the defect of alternating light and dark stripes is effectively treated, thus ensuring the high-speed and stable rolling process of the cold tandem rolling mill, improving the production efficiency of the strip production enterprise, and increasing the economic benefits of the enterprise. The present invention can be further popularized to other similar cold tandem rolling mills domestically, for optimization of the tension system for suppressing the vibration of the rolling mill during the high-speed rolling process of the cold tandem rolling mill, which has a broad prospect for popularization and application.

The invention claimed is:

1. An iterative method for suppressing vibration of a cold tandem rolling mill, the mill comprising a plurality of machine frames for processing steel strips, by optimizing the inlet tension value and the exit tension value for each of the plurality of frames, where the dimensional and process operational parameters of the rolling mill are defined as follows:

$R_i$ is a radius of a work roll of each machine frame;

$v_{ri}$ is a surface linear speed of a work roll of each machine frame;

$Ra_{ir0}$ is the original roughness of the work roll of each machine frame;

$B_{Li}$ is a roughness attenuation coefficient of the work roll;

$L_i$ is a rolling distance in kilometers of the work roll of each machine frame after exchange of the work roll, wherein, i=1, 2, . . . , n, represent the ordinal number of machine frames of the cold tandem rolling mill;

n is the total number of machine frames;

E is the elastic modulus of a steel strip;

ν is a Poisson's ratio of the steel strip;

B is the width of the steel strip;

$h_{0i}$ is the inlet thickness of the steel strip for each machine frame;

$h_{1i}$ is the exit thickness of the steel strip for each machine frame;

K is the value of the deformation resistance of the steel strip;

$P_i$ is the rolling force of each machine frame;

$v_{0i}$ is the inlet speed of the steel strip in front of each machine frame;

$k_c$ is the influence coefficient of an emulsion concentration;

θ is the viscosity compression coefficient of a lubricant;

$\eta_0$ is the value of the dynamic viscosity of the lubricant;

α is a bite angle for each machine frame and is the angle defined by the surfaces of the steel strip and a working roller;

$\psi_i^+$ is an upper threshold of a vibration determination index at an over-lubricated critical point at which a neutral angle coincides with and is equal to a bite angle, corresponding to a friction coefficient of a value at which slippage occurs between the steel strip drawn from the work roll and a region where a rolling force P is applied to the steel strip, thereby causing vibration of the rolling mill;

$\psi_i^-$ is a lower threshold of the vibration determination index at an under-lubricated critical point at which the neutral angle is half the bite angle, and at the point, an oil film between the work roll and the steel strip is prone to rupture, thereby causing the friction coefficient to increase suddenly, resulting in abnormal rolling pressure fluctuations, thereby causing vibration of the rolling mill;

$T_{0i}$ is the inlet tension value of each machine frame, $T_{1i}$ is an exit tension value, wherein $T_{01}=T_0$ and $T_{1n}=T_1$, the method comprising the steps of:

(i) assigning an initial set value of a current target tension system optimization function for suppressing vibration of the cold tandem rolling mill: $F_0=1.0\times 10^{10}$;

(ii) setting initial tension systems $T_{0i}$ and $T_{1i}$, wherein $T_{0i+1}=T_{1i}$;

(iii) for each machine frame, calculating a bite angle $\alpha_i$ as follows:

$$\alpha_i = \sqrt{\frac{\Delta h_i}{R_i'}},$$

where, $\Delta h_i=h_{0i}-h_{1i}$, $R_i'$ is a flattening radius of the work roll of the $i^{th}$ machine frame, and $$R_i' = R_i\left[1 + \frac{16(1-\nu^2)P_i}{\pi EB(h_{0i}-h_{1i})}\right];$$

(iv) calculating an oil film thickness $\xi_i$ in a current tension system as follows:

$$\xi_i = \frac{h_{0i}+h_{1i}}{2h_{0i}} \cdot k_c \cdot \frac{3\theta\eta_0(v_{ri}+v_{0i})}{\alpha_i[1-e^{-\theta(K-T_{0i})}]} - k_{rg}\cdot(1+K_{rs})\cdot Ra_{ir0}\cdot e^{-B_{Li}\cdot L_i},$$

where, $k_{rg}$ is a coefficient of the strength of entrainment of lubricant by the longitudinal surface roughness of the work roll and the steel strip, and $K_{rs}$ impression rate is defined as a ratio of transferring the surface roughness of the work roll to the strip steel;

(v) calculating, according to the relationship between a friction coefficient $u_i$ and the oil film thickness $\xi_i$, the friction coefficient $u_i=a_i+b_i \cdot e^{B_i \cdot \xi_i}$ between the work roll of each machine frame and the steel strip, wherein $a_i$ is a liquid friction coefficient of the $i^{th}$ machine frame, $b_i$ is a dry friction coefficient of the $i^{th}$ machine frame, and $B_i$ is a friction factor attenuation index of the $i^{th}$ machine frame;

(vi) calculating a neutral angle $\gamma_i$ of each machine frame in the current tension system according to the rolling theory as follows:

$$\gamma_i = \frac{1}{2}\sqrt{\frac{\Delta h_i}{R_i'}}\left[1 - \frac{1}{2u_i}\left(\sqrt{\frac{\Delta h_i}{R_i'}} + \frac{T_{i0} - T_{i1}}{P_i}\right)\right];$$

(vii) calculating a vibration determination index $\psi_i$ of each machine frame in the current tension system, wherein $$\psi_i = \frac{\gamma_i}{\alpha_i};$$

(viii) determining whether inequalities $\psi_i^- < \psi_i > \psi_i^+$ are established simultaneously and, if yes, continue to step (ix); if inequalities are not established, return to step (ii) and iteratively set new initial tension systems and repeat steps (iii)-(viii);

(ix) calculating a target comprehensive tension system optimization function:

$$F(X) = \lambda\sqrt{\frac{\sum_{i=1}^{n}(\psi_i - \psi_{0i})^2}{n}} + (1-\lambda)\max|\psi_i - \psi_{0i}|,$$

where, $\psi_{0i}$ is an optimal value of the vibration determination index, $$\psi_{0i} = \frac{\psi_i^+ + \psi_i^-}{2},$$

$\lambda$ is a distribution coefficient, and $X=\{T_{0i}, T_{1i}\}$ is an optimization variable;

(x) determining whether an inequality $F(X)<F_0$ is established and, if so, $T_{0i}^y=T_{0i}$, $T_{1i}^y=T_{1i}$, $F_0=F(X)$, continue to step (xi); if inequalities are not established, return to step (ii) and iteratively set new initial tension systems and repeat steps (iii)-(x);

(xi) determining whether the tension systems $T_{0i}$ and $T_{1i}$ are beyond a range of a feasible domain where the range of the feasible domain is from 0 to maximum values of $T_{0i}$ and $T_{1i}$; if yes, continue to step (xii); if no, return to step (ii) and iteratively set new initial tension systems within the attainable operational parameters of the rolling mill and repeat step (iii)-(xi); and (xii) setting the inlet tension value $T_{0i}^y$ and the exit tension value $T_{1i}^y$ for each machine frame in accordance with the values output for an optimal tension system, wherein the $T_{0i}^y$ and $T_{0i}^y$, respectively, are the $T_{0i}$ and $T_{0i}$ when the F(X) value calculated in the range of the feasible domain is minimized to thereby suppress the vibration of the cold tandem rolling mill.

2. The method according to claim 1, wherein the value of $k_{rg}$ is in a range of 0.09 to 0.15.

3. The method according to claim 1, wherein the value of $K_{rs}$ is in the range of 0.2 to 0.6.

4. The method according to claim 1, wherein the upper threshold $\psi_i^+$ of the vibration determination index is $\psi_i^+=1$, the lower threshold $\psi_i^-$ of the vibration determination index is $$\psi_i^- = \frac{1}{2},$$

and the optimal value of the vibration determination index is $$\psi_{0i} = \frac{\psi_i^+ + \psi_i^-}{2} = \frac{3}{4}.$$

* * * * *